US005991962A

United States Patent [19]

Nakatani

[11] Patent Number: 5,991,962

[45] Date of Patent: Nov. 30, 1999

[54] SCRUBBING UTENSIL HAVING BRIM OF LARGE WIDTH

[75] Inventor: Aiko Nakatani, Osaka, Japan

[73] Assignee: Nittern Inc., Osaka, Japan

[21] Appl. No.: 09/060,214

[22] Filed: Apr. 15, 1998

[51] Int. Cl.[6] ..... A47L 17/04; A47L 17/08

[52] U.S. Cl. ..... 15/244.3; 15/229.12

[58] Field of Search ..... 15/209.1, 229.11, 15/229.12, 244.1, 244.3, 244.4

*Primary Examiner*—Terrence R. Till

*Attorney, Agent, or Firm*—Armstrong, Westerman, Hattori, McLeland & Naugton

[57] ABSTRACT

Two pieces of fabric sandwiching an elastic core therebetween are stitched together along the periphery of the core to form a stitch line and confine the core. The fabric pieces project outward beyond the stitch line over the entire circumference thereof to form a finger protecting portion.

4 Claims, 9 Drawing Sheets

SCRUBBING UTENSIL HAVING BRIM OF LARGE WIDTH

FIELD OF THE INVENTION

The present invention relates to scrubbing utensils having a brim of large width for a wide variety of uses, e.g., for use in kitchens, bathrooms and other rooms for washing the human body, wiping furniture and floors, and washing and waxing motor vehicles, the utensils being adapted to protect fingers from damage, injury or soils during use.

BACKGROUND OF THE INVENTION

The scrubbing utensils heretofore proposed are prepared from various materials in many different shapes. Typical of such utensils are those in the form of a short bundle of fibers and prepared by bundling straw, hemp palm or like plant fibers or synthetic resin fibers in an elliptical shape, those made from metal by bundling thin narrow strips of aluminum or like metal, and those in the form of a piece of sponge for use as it is or as wrapped in netting. FIG. 16 shows such a scrubbing utensil as an example. The utensil is prepared by sandwiching a sponge 2*a* between two flexible sheets 1, 1*a* of cloth, and stitching the two sheets 1, 1*a* together as at 15 along their edges while pressing the periphery of the sponge (see Unexamined Japanese Utility Model Publication No. 55551/1994).

When the article to be cleaned is scrubbed with a conventional scrubbing utensil, the outer periphery of the utensil is held with the fingers of the hand, with the fingertips projecting outwardly of the utensil. While the utensil is being used for scrubbing in this state, it is likely that the fingertip will be forced against the article or come into striking contact with a sharp portion of the article to become damaged or injured. Further scorched soils on a pan or solid greasy soils are likely to lodge inside the nail tip, necessitating much time for removal.

SUMMARY OF THE INVENTION

An object of the present invention is to provide a scrubbing utensil which is adapted to protect the fingers of the hand from damage, injury or soiling during use.

The present invention provides a scrubbing utensil comprising an elastic core 2 sandwiched between two flexible sheets 1, 1*a*, the sheets being joined along a periphery of the core to form a line 3 for confining the elastic core 2, a sheet projecting outwardly of the confining line 3 in the form of a brim of large width to provide a finger protecting portion 4.

When the palm is placed over the elastic core 2, the fingertips of the hand spontaneously rest on the finger protecting portion 4 provided by the brim forming sheet.

Chinaware and metal kitchen utensils such as pots, pans and kettles can be effectively cleaned when scrubbed with the present utensil, with application of such a force as to lightly collapse the elastic core 2. Even if forcibly colliding with the article being scrubbed, the fingertip, which is placed on the protecting portion 4, will not come into direct contact with the article, whereby the finger can be prevented from becoming damaged or injured.

Further scorched soils are removable from the bottom of a pot by scrubbing with the present utensil, with the fingertips placed on the protecting portion 4. The nail tips can then be clear of the scorched soils.

When the scrubbing utensil is pushed into a glass for cleaning, the finger protecting portion 4 of the utensil is locally deformed at the glass bottom side to come into frictional contact with the corner between the bottom and the inner peripheral surface of the glass, whereby the corner of the glass bottom can be cleaned thoroughly despite the difficulty to be encountered otherwise.

The soils which are difficult to dislodge, such as boil over stains on a gas range, can be readily removed by scrubbing the soiled portion with the finger protecting portion 4 pressed there against with fingers 5.

The scrubbing utensil is well-suited also for use on the human body.

For use in bathing, small parts as in the interior of the ear which are inaccessible by the conventional scrubbing utensil of sponge can be cleaned with the finger protecting portion 4 pressed there against by the finger 5. The finger protecting portion 4 can be inserted also into the space between toes to thoroughly clean this part where soils are prone to be deposited.

DESCRIPTION OF THE PREFERRED EMBODIMENTS

Figure 1:
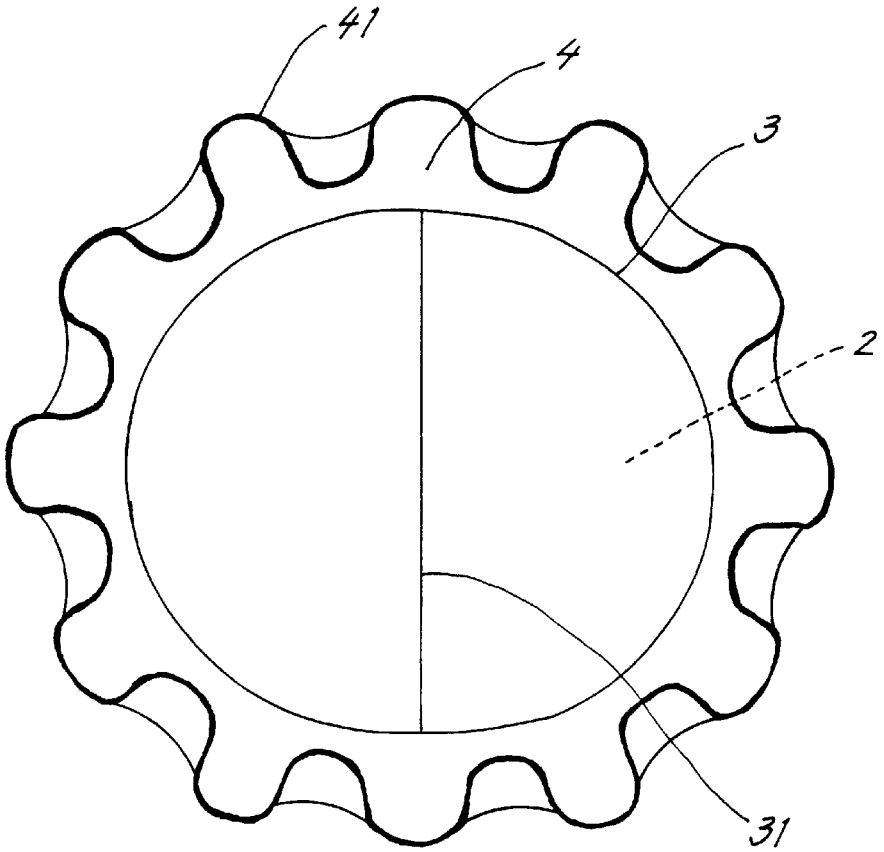
FIG. 1 is a front view of a scrubbing utensil.
Figure 2:
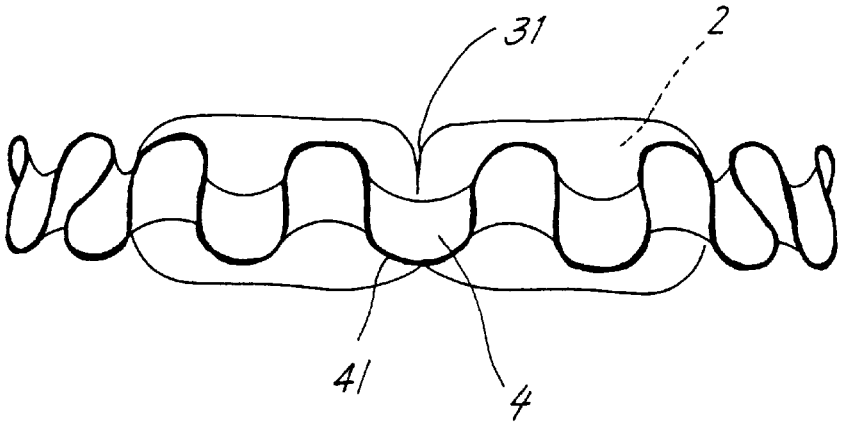
FIG. 2 is a side elevation of the utensil.
Figure 3:
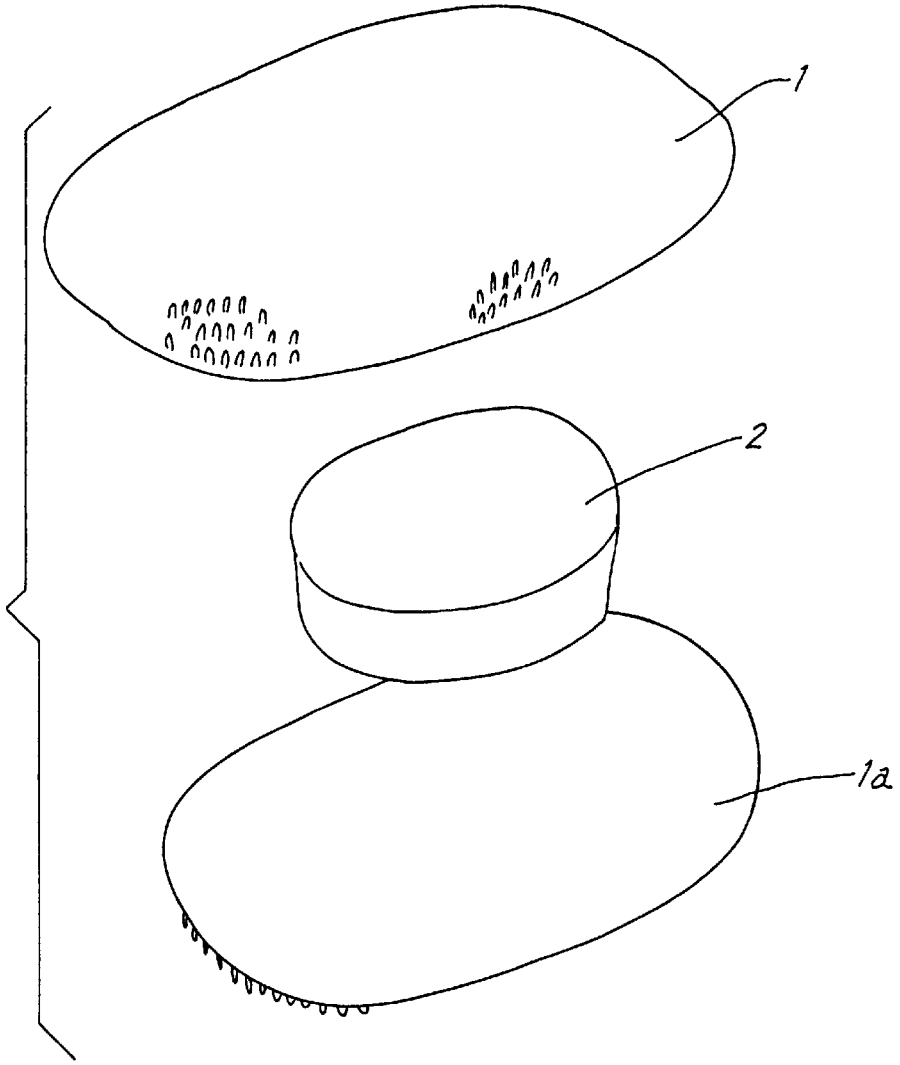
FIG. 3 is an exploded perspective view of the utensil.

FIG. 1 is a front view of a scrubbing utensil which is generally elliptical but nearly circular, and FIG. 3 is an exploded perspective view of the utensil.

The utensil comprises a generally elliptical core 2 made of urethane sponge and sandwiched between two stretchable sheets 1, 1*a* generally elliptical and larger than the core 2. A confining line 3 is formed by stitching the sheets 1, 1*a* together along the periphery of the elastic core 2 so as to enclose the core 2 as shown in FIG. 1. The elastic core 2 is enclosed with the sheets 1, 1*a* and immovable as confined inwardly of the line 3.

The two sheets 1, 1*a* are stitched together along their peripheral edges by overhanding 41. The portions of the two sheets 1, 1*a* lapping over each other and positioned between the elliptical stitch line 3 and the peripheral edges provide a finger protecting portion 4 extending over the entire circumference with an approximately constant width.

For overhanding 41, stitches are closely formed by a nylon woolly yarn according to the present embodiment. Since the edges of the stretchable sheets 1, 1*a* are overhanded as stretched, the resulting edge formed by overhanding remains stretched and becomes difficult to stretch. Consequently, the finger protecting portion 4 is deformed to a wavy form circumferentially thereof over the entire perimeter, and is in the form of a frill in its entirety. For overhanding, it is desired to use a yarn which is elastic and resistant to chemicals, such as a polyester yarn, acrylic yarn or nylon yarn. A nylon woolly yarn is used in the embodiment.

The two sheets 1, 1*a* are a pile fabric knitted on a circular knitted machine from acrylic filaments obtained by wet spinning and have a pile of loops on the outer side. The pile fabric includes stretchable yarns, such as nylon woolly yarns, serving as core yarns and are therefore highly stretchable.

Figure 4:
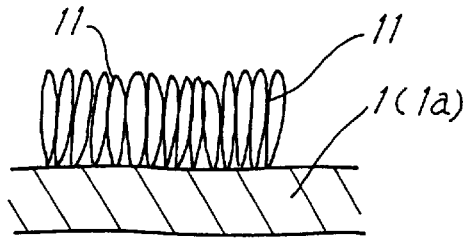
FIG. 4 is an enlarged view in section of a surface portion of the utensil.
Figure 5:
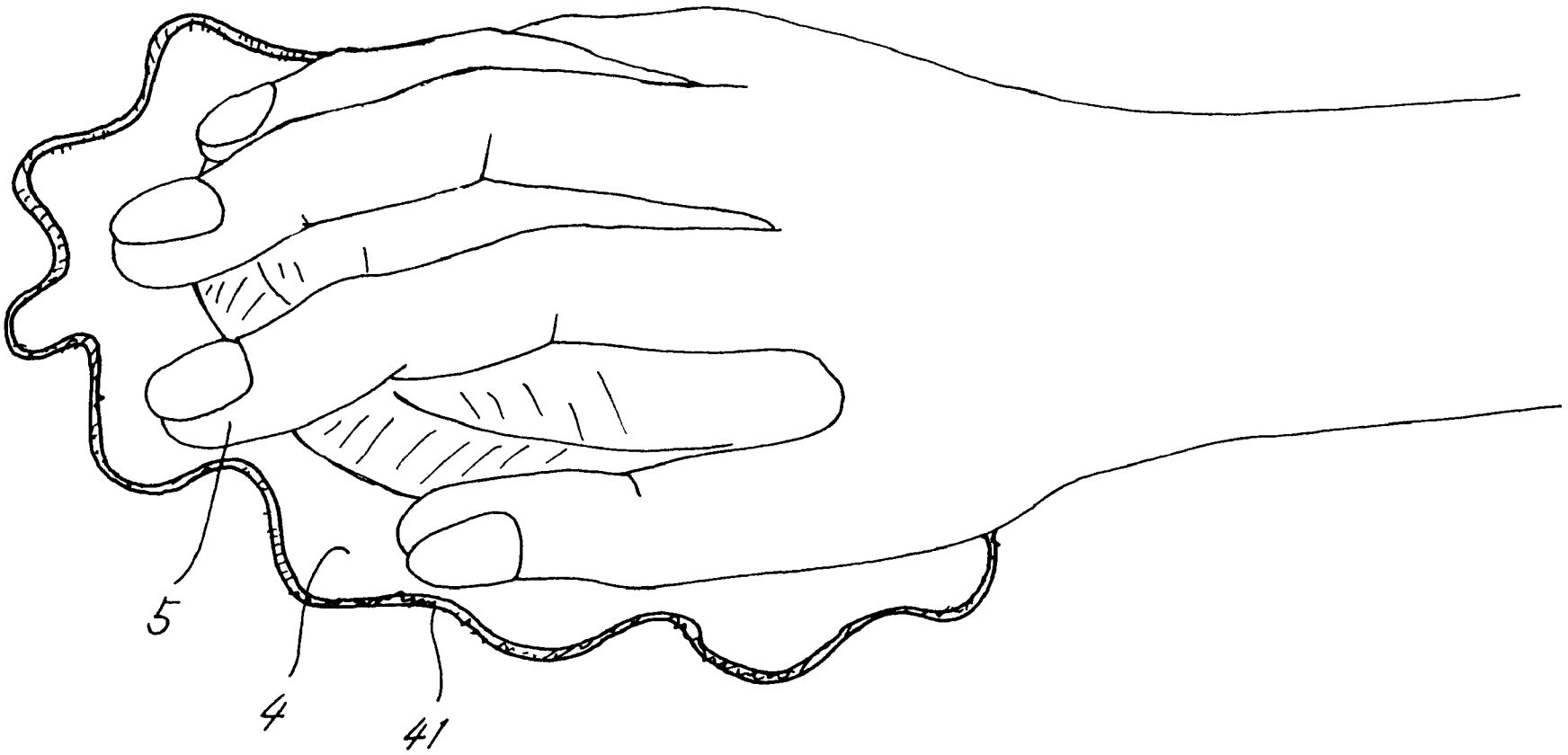
FIG. 5 is a perspective view of the utensil in use.
Figure 9:
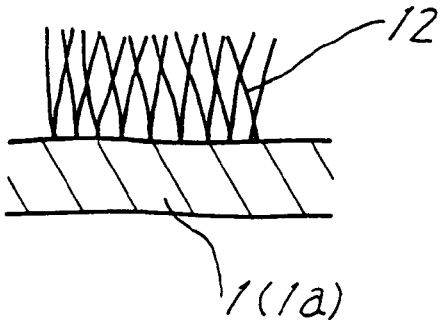
FIG. 9 is a sectional view of another embodiment having a pile of bifurcated tufts formed by cutting the ends of loops.

As shown in FIG. 4, the pile is formed by loops standing up approximately vertically on the fabric surface and arranged closely. Owing to the contraction of the fabric, the pile of loops is difficult to identify as such in appearance. The loops may be cut at their ends to obtain a pile of closely arranged bifurcated tufts as shown in FIG. 9.

The opposite sheets 1, 1*a* are stitched together through the core 2 approximately at the midportion of the length of the utensil to form a fold line 31 in the direction of the minor diameter of the elliptical confining line 3. The stitching yarn forming the fold line 31 extends through the elastic core 2, constricting the core 2 in the direction of its thickness.

When the scrubbing utensil is held by hand with the palm placed over the elastic core 2, the fingertips spontaneously rest on the finger protecting portion 4.

Chinaware and metal kitchen utensils such as pots, pans and kettles can be effectively cleaned when scrubbed with the present utensil, with application of such a force as to lightly collapse the elastic core 2. Even if forcibly colliding with the article being scrubbed, the fingertip, which is placed on the protecting portion 4, will not come into direct contact with the article but can be prevented from becoming damaged or injured.

Further scorched soils are removable from the bottom of a pot by scrubbing with the present utensil, with the fingertips placed on the protecting portion 4. The portion 4 prevents the scorched soils from lodging inside the nail tips.

The scrubbing utensil of the present embodiment is covered with a pile of acrylic filaments over the surface. Tableware or like article can be neatly cleaned with the outer ends of the closely arranged loops forming the pile surface as if by polishing without defacement.

Even when the article to be cleaned is a glass having a cut pattern, upstanding tufts fit into small grooves of the cut pattern to scrape off soils from the groove bottom. Accordingly, the glass can be cleaned more effectively than is expectable with the conventional sponge utensil.

The elastic core 2 is wrapped in the flexible sheets 1, 1*a*, so that when the inner and outer curved surfaces of glasses or cups are to be cleaned, the elastic sponge core 2 elastically deforms, permitting the entire pile surface to come into contact with the curved surface to effectively remove soils.

Figure 6:
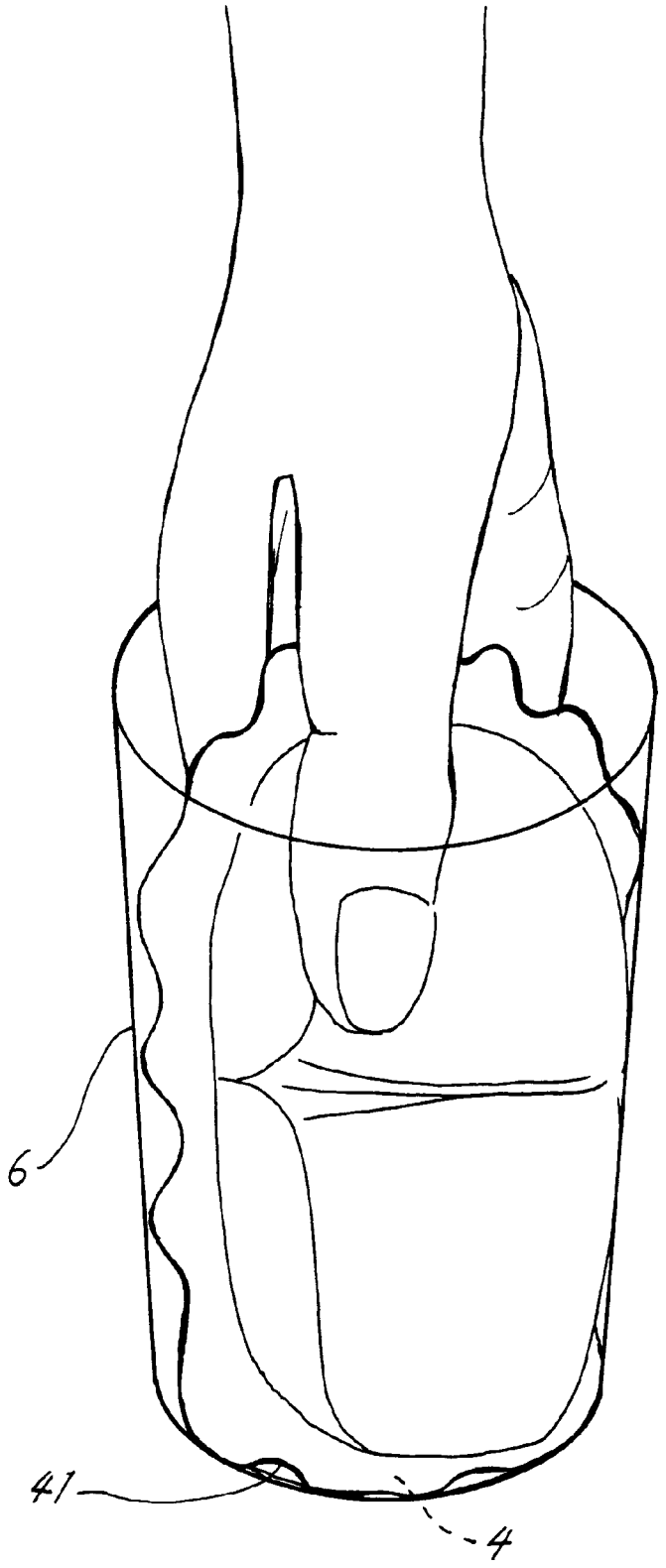
FIG. 6 is a perspective view of the utensil in use for cleaning a glass.

Further when the scrubbing utensil is pushed into a glass for cleaning as shown in FIG. 6, the finger protecting portion 4 is locally deformed at the glass bottom side to come into contact with the corner between the bottom and the inner peripheral surface of the glass, whereby the corner can be cleaned without intentionally directing attention to the corner portion. Because the finger protecting portion 4 is formed by the pile fabric which is highly elastic and further because this portion 4 is pleated, the fabric providing this portion has suitable stiffness. When pressed against the corner of the glass, the protecting portion 4 therefore produces an enhanced cleaning effect by virtue of increased friction between the glass and the portion 4.

According to the present embodiment, the outer peripheral edge of the finger protecting portion 4 is overhanded with closely arranged stitches of nylon woolly yarn and thereby reinforced over the entire circumference and has greater stiffness than the rest of the portion 4. Consequently, the soil lodging in the corner of the bottom of the glass can be thoroughly scraped off with the protecting portion 4. In this way, even the glass bottom which is not readily accessible can be cleaned completely.

Further in cleaning narrow grooves such as circumferential grooves of pot lids and seal grooves of closable resin containers, the grooved portion is scrubbed with the overhanded part 41 of the finger protecting portion 4 as pushed into the groove, whereby the soils lodging in the groove can be scraped off to clean the groove thoroughly.

The overhanded part 41 formed along the outer peripheral edge of the finger protecting portion 4 precludes the edge of the portion 4 from fraying to make the portion tough and durable.

Since the utensil is readily foldable in two along the central fold line 31, chopsticks, knives, spoons or like barlike small articles can be cleaned efficiently and neatly as held between the folded portions of the utensil.

Figure 7:
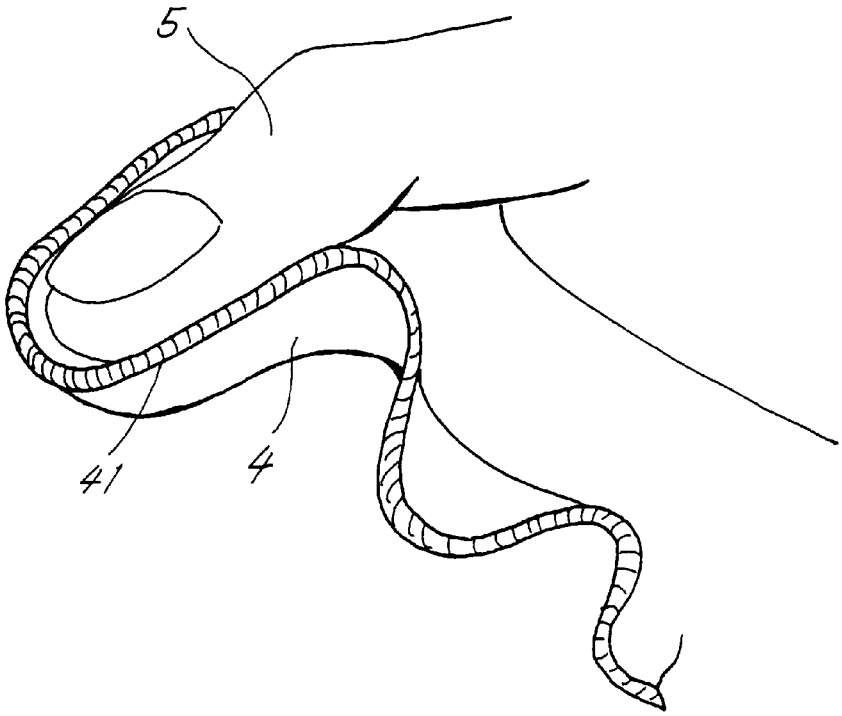
FIG. 7 is a perspective view of a finger as fitted to a finger protecting portion.

The soils which are difficult to dislodge, such as boil over stains on a gas range, can be readily removed by scrubbing the soiled portion with the finger protecting portion 4 pressed there against with fingers 5 as shown in the perspective view of FIG. 7. Since the finger protecting portion 4 is pleated in a wavy form, the pleat fits to the fingertip as if wrapping as seen in FIG. 7 when the fingers of the hand is placed on the portion 4. The utensil is therefore easy to use.

The scrubbing utensil comprising the elastic core 2 of sponge wrapped in a pile fabric feels soft and is accordingly suited to use also for cleaning the human body. The outer ends of closely arranged upstanding tufts on the surface of the pile reach furrows in the skin while smoothing wrinkles, and also reach every part of the skin surface including hair root portions and sweat gland portions, consequently washing off the dirt effectively.

Even the inside of the ear can be cleaned with the finger 5 fitted to the finger protecting portion 4 of the utensil as shown in FIG. 7. The protecting portion 4 can be inserted also into the space between toes to thoroughly clean this part which is prone to the deposition of dirt.

The scrubbing utensil of the present invention is suitable for washing and waxing motor vehicles and for wiping furniture and floors dry without defacement.

The acrylic fiber forming the pile fabric is tough and resistant to acids, alkalis and detergents, so that the scrubbing utensil is suited to use in kitchens where such utensils are frequently used along with an alkaline detergent for cleaning tableware smeared with acid seasonings.

The acrylic fiber can be colored effectively, has color fastness and is therefore useful for making scrubbing utensils having a beautiful loud color.

The acrylic fiber has high resistance to moisture and heat and is less likely to become impaired in strength even if allowed to stand in hot water.

Further the acrylic fiber prepared by wet spinning and used in the embodiment is easy to dry and therefore sanitary.

The material of the elastic core 2 is not limited to urethane sponge; natural sponge, 10 of a, nonwoven fabric, synthetic resin cotton or any other material is usable insofar as the material is elastic. Preferably, the elastic core 2 is made of a material, such as nylon, polyester or acrylic fiber, which is resistant to weakly alkaline detergents which are generally used in kitchens.

Figure 15:
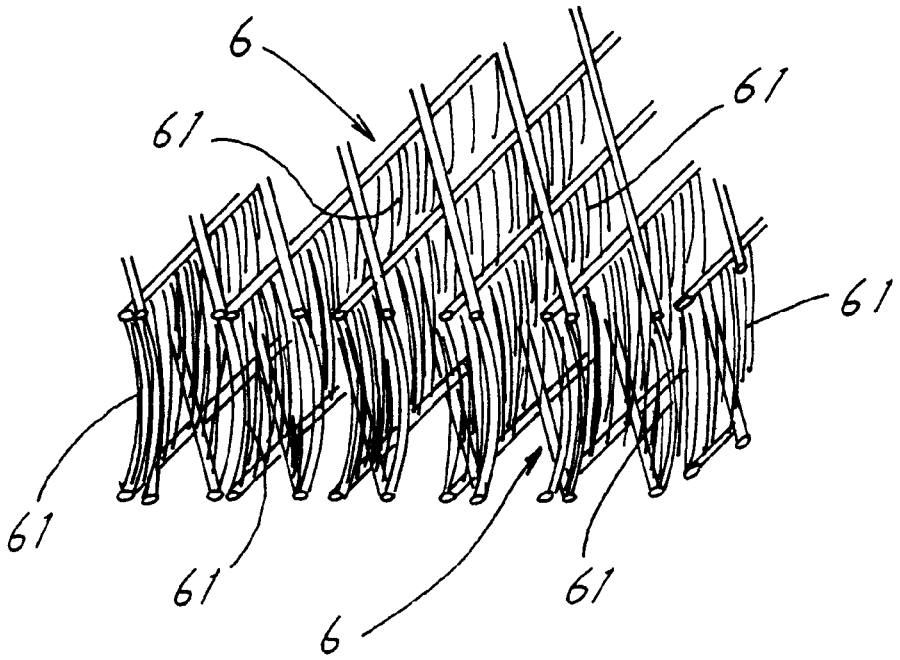
FIG .15 PRIOR ART
FIG. 15 is a perspective view of a three-dimensional knitted fabric for use as an elastic core.
Figure 16:
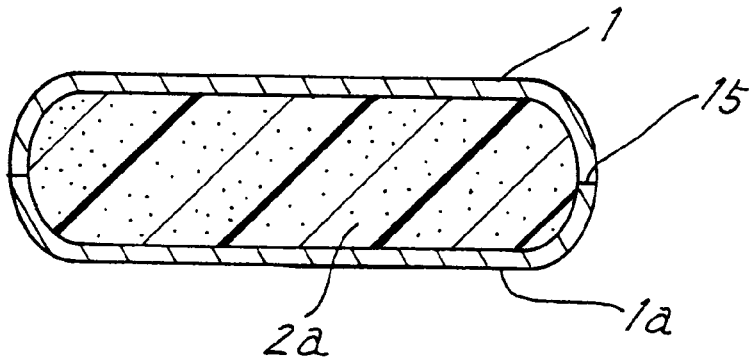
FIG .16 PRIOR ART
FIG. 16 is a sectional view of a conventional scrubbing utensil.

FIG. 15 shows a net like three-dimensional knitted fabric comprising two nets 6, 6 of synthetic resin yarns, and numerous thin yarns 61 made of the same synthetic resin as the yarns and interconnecting the nets 6, 6. This fabric is commercially available as a utensil for cleaning the human body. From the viewpoint of elasticity, draining property and resistance to chemicals, it is most suitable to use this fabric in the form of a multiplicity of superposed layers as the elastic core 2.

The material of the flexible sheets 1, 1*a* for enclosing the elastic core 2 is not limited to a pile fabric. A knitted fabric, woven fabric, nonwoven fabric, synthetic leather, synthetic rubber sheet or any other material is usable. However, it is desirable that the material have high chemical resistance so as to be resistant to detergents and waxes.

The use of the flexible sheets 1, 1*a* having high stretchability as in the embodiment makes it easy to enclose the elastic core 2 and to pleat the finger protecting portion 4 as described above. The pleats produce an improved aesthetic effect, giving an unexpectable interesting and lovely appearance to the utensil, in addition to the practical effect previously stated to excite a desire to purchase the utensil.

When the flexible sheets 1, 1*a* and the elastic core 2 are made of fusible materials, the confining line 3 and fold line 31 can be formed alternatively by pressing the sheets 1, 1*a* against the core 2 by a heating piece (not shown).

Figure 8:
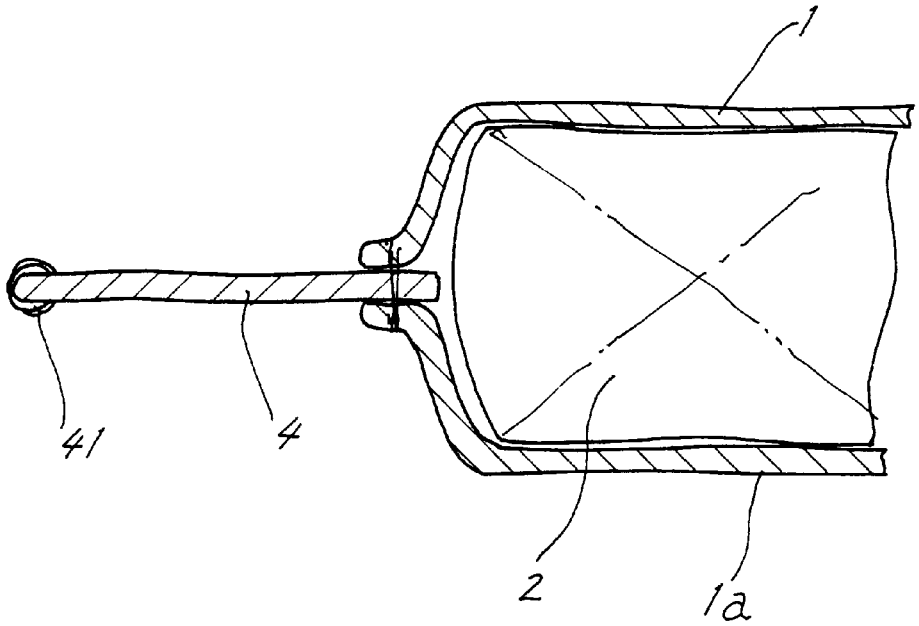
FIG. 8 is a fragmentary view in section of another scrubbing utensil having a finger protecting portion formed by a separate piece of fabric.

FIG. 8 shows another embodiment wherein a finger protecting portion 4 is made of a material separate from flexible sheets 1, 1*a* enclosing an elastic core 2. In this case, the flexible sheets 1, 1*a* can be prepared from a knitted pile fabric, and the protecting portion 4 from a woven fabric.

Figure 10:
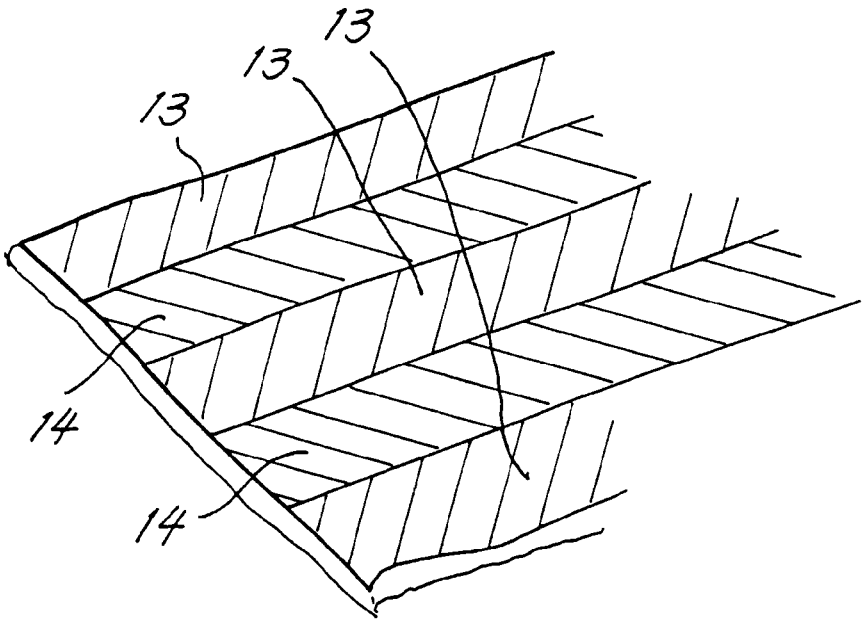
FIG. 10 is a perspective view of another embodiment of pile fabric.

FIG. 10 shows another embodiment of pile fabric for providing the surface of a scrubbing utensil. Arranged alternately on the surface of the fabric are different kinds of piles which are different in characteristics and each in the form of a strip, e.g., an acrylic pile 13 and a nylon pile 14.

Figure 11:
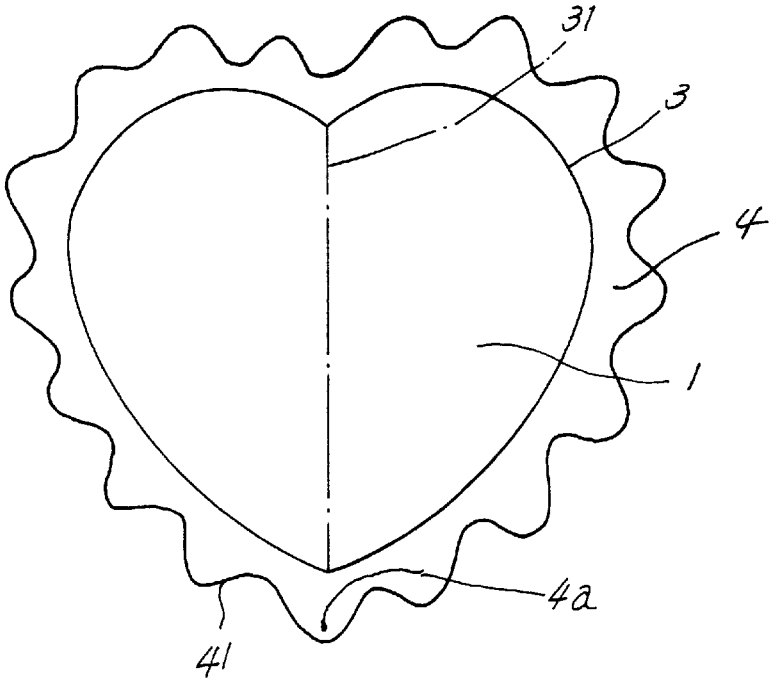
FIG. 11 is a front view of another scrubbing utensil having a heart-shaped core.

FIG. 11 shows a heart-shaped scrubbing utensil comprising a heart-shaped core and having a confining line 3 formed along the periphery of the core. Since a finger protecting portion 4 has a sharp end 4*a* at the lower end of the heart-shaped utensil, the utensil is suitable for cleaning small portions such as the spout of a teapot. Opposite sheets 1, 1*a* may be stitched together approximately centrally of the utensil to form a fold line 31 as indicated in a chain line.

Figure 12:
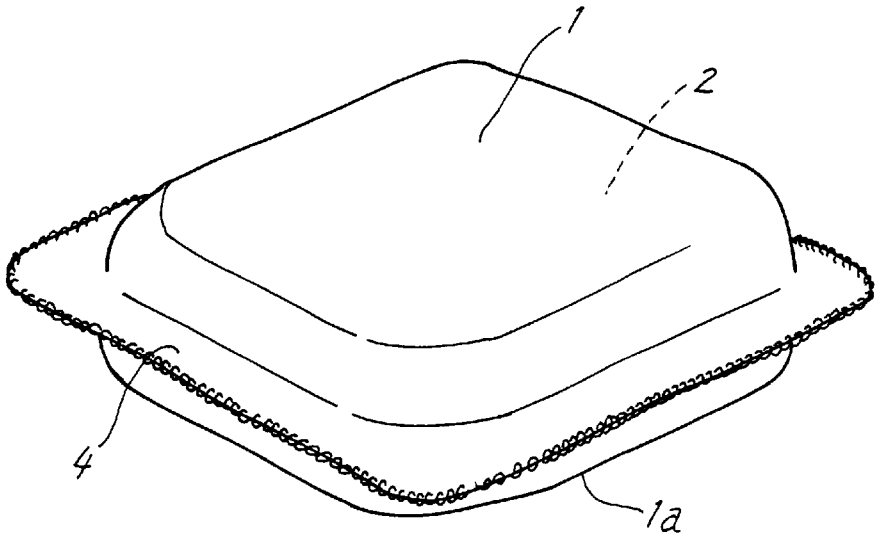
FIG. 12 is a perspective view of a scrubbing utensil having a generally rectangular core.

FIG. 12 shows an approximately rectangular scrubbing utensil. A pile fabric having small stretchability is used over the surface. Accordingly, a peripheral finger projecting portion 4 has no wavy pleat.

Figure 13:
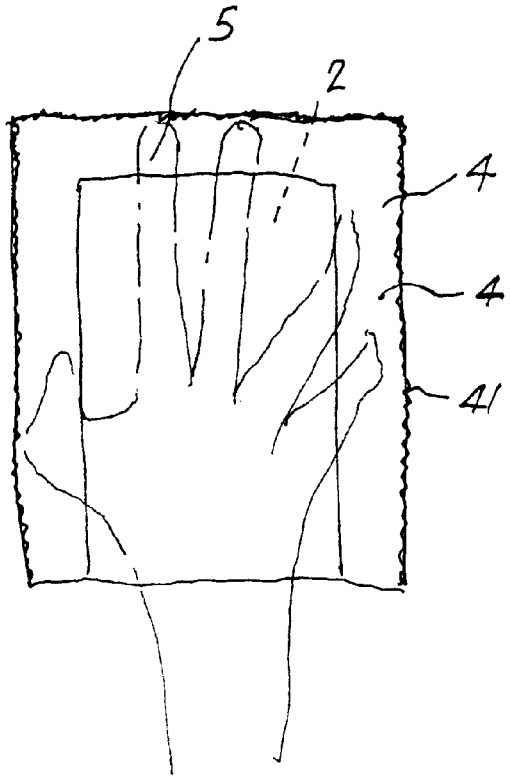
FIG. 13 is a front view showing a rectangular scrubbing utensil having a finger protecting portion extending along three side edges.
Figure 14:
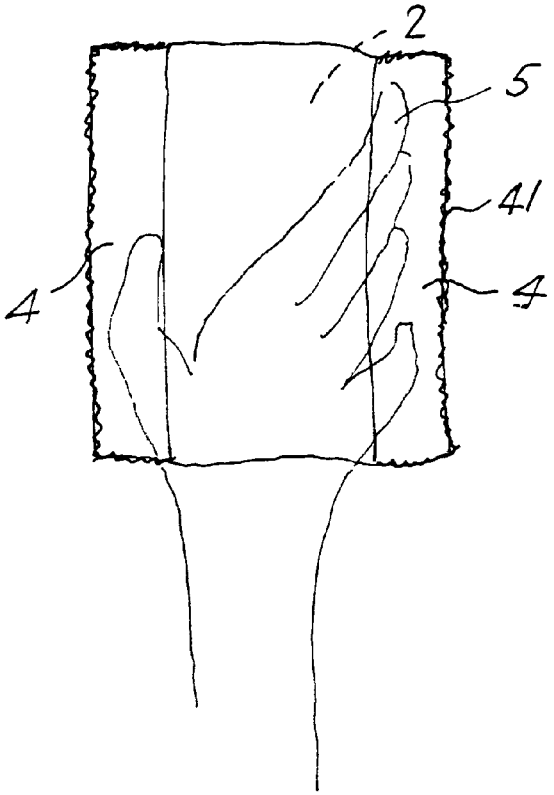
FIG. 14 is a front view of a rectangular scrubbing utensil having finger protecting portions along two side edges.

FIG. 13 shows another embodiment of rectangular scrubbing utensil which has a finger protecting portion 4 extending along three side edges, i.e., opposite long side edges and one short side edge. FIG. 14 shows another embodiment of rectangular scrubbing utensil having finger protecting portions 4 along opposite long side edges, respectively.

When the utensil is held by hand with the fingers 5 placed on the protecting portion 4, the fingers can be protected as shown in FIG. 13 or 14.

What is claimed is:

1. A scrubbing utensil having a brim of large width, the utensil comprising an elastic core sandwiched between two flexible sheets, the sheets being joined along a periphery of the elastic core to form a line for confining the core, a sheet projecting outwardly of the confining line to form the brim of large width and provide a finger protecting portion, wherein at least one of the two flexible sheets is a pile fabric having a pilc on an outer surface thereof.

2. A scrubbing utensil having a brim of large width, the utensil comprising an elastic core sandwiched between two flexible sheets, the sheets being joined along a periphery of the elastic core to form a line for confining the core, a sheet projecting outwardly of the confining line to form the brim of large width and provide a finger protecting portion, wherein the elastic core and the sheets are joined into an assembly, and the assembly has a fold line and is foldable in two along the fold line, the fold line being formed by stitching the two sheets together through the elastic core so as to constrict the core in the direction of thickness thereof, or by pressing the sheets against the elastic core by a heating piece so as to collapse a pile over a surface of each of the sheets in the form of a line and fuse the sheets to the core.

3. A scrubbing utensil having a brim of large width, the utensil comprising an elastic core sandwiched between two flexible sheets, the sheets being joined alone a periphery of the elastic core to form a line for confining the core, a sheet projecting outwardly of the confining line to form the brim of large width and provide a finder protecting portion, wherein the finger projecting portion is overhanded along an entire outer peripheral edge thereof to pleat the protecting portion in the form of waves.

4. A scrubbing utensil having a brim of large width, the utensil comprising an elastic core sandwiched between two flexible sheets, the sheets being joined along a periphery of the elastic core to form a line for confining the core, a sheet projecting outwardly of the confining line to form the brim of large width and provide a finger protecting portion, wherein the sheet providing the finger protecting portion is made of a material separate from the flexible sheets and has a base edge joined to the confining line of the sheets.

* * * * *